US008636875B2

(12) United States Patent
McKay

(10) Patent No.: US 8,636,875 B2
(45) Date of Patent: Jan. 28, 2014

(54) ENHANCED DRY STRENGTH AND DRAINAGE PERFORMANCE BY COMBINING GLYOXALATED ACRYLAMIDE-CONTAINING POLYMERS WITH CATIONIC AQUEOUS DISPERSION POLYMERS

(75) Inventor: Jonathan M. McKay, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 13/354,893

(22) Filed: Jan. 20, 2012

(65) Prior Publication Data

US 2012/0186764 A1 Jul. 26, 2012

Related U.S. Application Data

(60) Provisional application No. 61/434,541, filed on Jan. 20, 2011.

(51) Int. Cl.
*D21H 17/37* (2006.01)
*D21H 17/44* (2006.01)

(52) U.S. Cl.
USPC ..... 162/168.3; 162/164.6; 162/164.7

(58) Field of Classification Search
USPC ..... 162/158, 164.1, 164.6, 168.1–168.3, 162/183
See application file for complete search history.

(56) References Cited

U.S. PATENT DOCUMENTS

| | | | | | |
|---|---|---|---|---|---|
| 3,556,932 | A * | 1/1971 | Coscia et al. | ..... | 162/166 |
| 3,840,489 | A * | 10/1974 | Strazdins | ..... | 524/816 |
| 4,217,425 | A * | 8/1980 | Ballweber et al. | ..... | 525/155 |
| 4,233,411 | A * | 11/1980 | Ballweber et al. | ..... | 525/155 |
| 4,508,594 | A * | 4/1985 | Jansma et al. | ..... | 162/135 |
| 4,605,702 | A * | 8/1986 | Guerro et al. | ..... | 525/154 |
| 5,490,904 | A * | 2/1996 | Jansma et al. | ..... | 162/168.2 |
| 5,674,362 | A * | 10/1997 | Underwood et al. | ..... | 162/164.3 |
| 5,783,041 | A * | 7/1998 | Underwood | ..... | 162/164.1 |
| 5,938,937 | A | 8/1999 | Sparapany et al. | | |
| 6,939,443 | B2 | 9/2005 | Ryan et al. | | |
| 7,323,510 | B2 | 1/2008 | Fischer et al. | | |
| 7,828,934 | B2 * | 11/2010 | Cyr et al. | ..... | 162/166 |
| 7,863,395 | B2 * | 1/2011 | Hagiopol et al. | ..... | 526/220 |
| 7,897,013 | B2 * | 3/2011 | Hagiopol et al. | ..... | 162/166 |
| 8,288,502 | B2 * | 10/2012 | Bode et al. | ..... | 528/246 |
| 2003/0234089 | A1 | 12/2003 | Ryan et al. | | |
| 2004/0118540 | A1 | 6/2004 | Garnier et al. | | |
| 2006/0249269 | A1 * | 11/2006 | Kurian et al. | ..... | 162/168.3 |
| 2008/0149287 | A1 | 6/2008 | Hagiopol et al. | | |
| 2010/0193148 | A1 * | 8/2010 | McKay et al. | ..... | 162/164.6 |
| 2011/0056640 | A1 * | 3/2011 | Cyr et al. | ..... | 162/164.1 |
| 2011/0146925 | A1 * | 6/2011 | Bode et al. | ..... | 162/164.1 |
| 2011/0155339 | A1 * | 6/2011 | Brungardt et al. | ..... | 162/164.6 |
| 2012/0103547 | A1 * | 5/2012 | Grimm et al. | ..... | 162/164.1 |
| 2012/0186764 | A1 * | 7/2012 | McKay | ..... | 162/164.6 |

FOREIGN PATENT DOCUMENTS

| | | | |
|---|---|---|---|
| EP | 1579071 | | 7/2008 |
| WO | 9739189 | | 10/1997 |
| WO | 0165009 | | 9/2001 |
| WO | 2008036127 | | 8/2008 |
| WO | WO 2010088473 | A1 * | 8/2010 |
| WO | 2011090672 | | 7/2011 |
| WO | WO 2012100156 | A1 * | 7/2012 |

OTHER PUBLICATIONS

International Search Report, PCT/US2012/022020, dated Jun. 21, 2012, p. 3.

* cited by examiner

*Primary Examiner* — Jose Fortuna
(74) *Attorney, Agent, or Firm* — Joanne Rossi; Shaorong Chen; Michael Herman

(57) ABSTRACT

A process is disclosed for the production of paper with enhanced dry strength comprising adding to the wet end of a paper machine, (a) a glyoxalated acrylamide-containing polymer and (b) a cationic aqueous dispersion polymer. Guidelines for the properties of the polymers that make this coadditive system effective are established. Polymer properties discussed include molecular weight, cationic charge, polymer composition and functionalization, and relative additive amounts.

18 Claims, No Drawings

ENHANCED DRY STRENGTH AND DRAINAGE PERFORMANCE BY COMBINING GLYOXALATED ACRYLAMIDE-CONTAINING POLYMERS WITH CATIONIC AQUEOUS DISPERSION POLYMERS

This application claims the benefit of U.S. provisional application No. 61/434,541, filed Jan. 20, 2011, the entire contents of which are hereby incorporated by reference.

FIELD OF THE INVENTION

This invention relates to enhanced dry strength in paper using a process of treating a pulp slurry with a combination of a glyoxalated acrylamide-containing polymer and a cationic aqueous dispersion polymer.

BACKGROUND OF THE INVENTION

Maintaining high levels of dry strength is a critical parameter for many papermakers. Obtaining high levels of dry strength may allow a papermaker to make high performance grades of paper where greater dry strength is required, use less or lower grade pulp furnish to achieve a given strength objective, increase productivity by reducing breaks on the machine, or refine less and thereby reduce energy costs. The productivity of a paper machine is frequently determined by the rate of water drainage from a slurry of paper fiber on a forming wire. Thus, chemistry that gives high levels of dry strength while increasing drainage on the machine is highly desirable.

Glyoxalated acrylamide-containing polymers are known to give excellent dry strength when added to a pulp slurry.

U.S. Pat. No. 5,938,937 teaches that an aqueous dispersion of a cationic amide-containing polymer can be made wherein the dispersion has a high inorganic salt content.

U.S. Pat. No. 7,323,510 teaches that an aqueous dispersion of a cationic amide-containing polymer can be made wherein the dispersion has a low inorganic salt content.

European Patent No. 1,579,071 B1 teaches that adding both a vinylamine-containing polymer and a glyoxalated polyacrylamide polymer gives a marked dry strength increase to a paper product, while increasing the drainage performance of the paper machine. This method also significantly enhances the permanent wet strength of a paper product produced thereby. Many cationic additives, but especially vinylamine-containing polymers, are known to negatively affect the performance of optical brightening agents (OBA). This may prevent the application of this method into grades of paper containing OBA.

According to U.S. Pat. No. 6,939,443, the use of combinations of polyamide-epichlorohydrin (PAE) resins with anionic polyacrylamide additives with specific charge densities and molecular weights can enhance the dry strength of a paper product. However, these combinations also may elevate the wet strength of the resultant paper to the point that repulping broke paper is extremely difficult and inefficient.

BRIEF DESCRIPTION OF THE INVENTION

This invention relates to the use of glyoxalated acrylamide-containing polymers in the presence of cationic aqueous dispersion polymers. This combination results in paper with excellent dry strength properties as well as enhanced drainage performance on a paper machine.

Treatment of a pulp slurry with a combination of a glyoxalated acrylamide-containing polymer (also referred to as glyoxalated polyacrylamide polymer) and a cationic aqueous dispersion polymer results in paper with enhanced dry strength and also gives good drainage performance on a paper machine.

One embodiment of the invention is a process for the production of paper, board, and cardboard with enhanced dry strength comprising adding to the wet end of a paper machine (a) a glyoxalated acrylamide-containing polymer and (b) a cationic aqueous dispersion polymer.

In one embodiment of the process the glyoxalated polyacrylamide polymer is comprised of an acrylamide-containing prepolymer treated subsequently with glyoxal, wherein the acrylamide-containing prepolymer has a molecular weight of from 1,000 to 250,000 daltons.

In one embodiment of the process the cationic aqueous dispersion polymer is a product comprised of a highly cationic lower molecular weight dispersant phase and a less cationic higher molecular weight discrete phase. The discrete phase has a cationic charge of from 5% to 60% on a molar basis. The weight average molecular weight of the product ranges from 250,000 to 2,500,000 daltons.

In one embodiment of the process the glyoxalated polyacrylamide polymer and the cationic aqueous dispersion polymer are added to the wet end of a paper machine in a ratio of cationic aqueous dispersion polymer to glyoxalated polyacrylamide polymer of from 10:1 to 1:50, in an amount of from 0.05% to 0.80% on a weight basis of the dry pulp, based on the active polymer solids of the polymeric products.

One embodiment of the invention is the paper product produced by the process of adding to the wet end of a paper machine (a) a glyoxalated polyacrylamide polymer having a prepolymer molecular weight of from 1,000 daltons to 250,000 daltons and (b) a cationic aqueous dispersion polymer having a molecular weight of from 250,000 daltons to 2,500,000 daltons.

In another embodiment, the invention relates to the method of treating a cellulosic pulp slurry in the wet end of a paper machine with (a) glyoxalated acrylamide-containing polymer and (b) a cationic aqueous dispersion polymer. It is preferred that the glyoxalated acrylamide-containing polymer is added to the pulp slurry first, followed by the cationic aqueous dispersion polymer.

DETAILED DESCRIPTION OF THE INVENTION

As used herein, the singular terms "a" and "the" are synonymous and used interchangeably with "one or more" or "at least one" unless the context clearly indicates a contrary meaning. Accordingly, for example, reference to "a compound" herein or in the appended claims can refer to a single compound or more than one compound. Additionally, all numerical values, unless otherwise specifically noted, are understood to be modified by the word "about."

The invention is based in the discovery that the performance of a paper machine and the paper products derived thereby can be greatly enhanced by the treatment of the pulp slurry with a combination of (a) a glyoxalated polyacrylamide polymer and (b) a cationic aqueous dispersion-polymer.

The combination of the two polymers unexpectedly resulted in greater dry strength than could be realized with either polymer alone based on total active polymer content. Furthermore, the excellent drainage performance achieved in the presence of the cationic aqueous dispersion polymer is essentially maintained when used in combination with glyoxalated acrylamide-containing polymer.

A typical glyoxalated acrylamide-containing polymer is produced by first polymerizing acrylamide and at least one additional monomer in an aqueous medium, producing a prepolymer that is later reacted with glyoxal to form the final glyoxalated acrylamide-containing polymer. The aqueous prepolymer solution may have an active polymer content of from 10% to 50%, more preferably from 15% to 45%, most preferably from 20% to 40% on a weight basis. The amount of the at least one additional monomer may range of from 2% to 40%, more preferably from 3% to 35%, most preferably from 4% to 30% on a molar basis of the prepolymer.

The molecular weight of the prepolymer is a critical parameter in determining the performance of the final product. The dry strength performance of the glyoxalated polyacrylamide polymer is best when the molecular weight of the prepolymer is from 1,000 to 250,000 daltons, more preferably from 3,000 to 75,000 daltons, most preferably from 5,000 to 50,000 daltons. Although the dry strength of the final polymer is theoretically maximized with the highest possible molecular weight of prepolymer, reaction of a high molecular weight prepolymer with glyoxal results in a final product that either exhibits viscosity instability, or has a very low active polymer solids content. Either result results in a product that is not desirable.

Another important parameter in the performance of the glyoxalated acrylamide-containing polymer is the degree of total glyoxal functionalization of the acrylamide moiety in the prepolymer. A determination of the degree of glyoxal functionalization can be made by NMR analysis. The degree of total glyoxal functionalization ranges of from 3% to 40%, more preferably from 5% to 25%, more preferably from 7% to 30%, most preferably from 8% to 14%, also preferably from 6% to 20% of the acrylamide units in the prepolymer. Polymers above these levels are prone to either viscosity instability or low active polymer solids, as described above. Polymers with degree of glyoxal functionalization below these levels are not efficient in bonding with the cellulose fibers, and thus show little dry strength improvement relative to paper not subjected to treatment with a glyoxalated polyacrylamide polymer.

Another consideration in the performance of the glyoxalated acrylamide-containing polymer is the charge of the polymer. A glyoxalated polyacrylamide polymer is more effective when the prepolymer is made with a cationic comonomer in the range of from 2% to 40%, more preferably from 3% to 35%, more preferably from 4% to 35%, most preferably from 4% to 30% on a molar basis of the total monomer charge of the prepolymer. Suitable cationic comonomers include, but are not limited to, diallyldimethylammonium chloride (DADMAC), 2-(dimethylamino)ethyl acrylate, 2-(dimethylamino)ethyl methacrylate, 2-(diethylaminoethyl) acrylate, 2-(diethylamino)ethyl methacrylate, 3-(dimethylamino)propyl acrylate, 3-(dimethylamino)propyl methacrylate, 3-(diethylamino)propyl acrylate, 3-(diethylamino)propyl methacrylate, N-[3-(dimethylamino)propyl]acrylamide, N-[3-(dimethylamino)propyl]methacrylamide, N-[3-(diethylamino)propyl]acrylamide, N-[3-(diethylamino)propyl]methacrylamide, [2-(acryloyloxy)ethyl]trimethylammonium chloride, [2-(methacryloyloxy)ethyl]trimethylammonium chloride, [3-(acryloyloxy)propyl]trimethylammonium chloride, [3-(methacryloyloxy)propyl]trimethylammonium chloride, 3-(acrylamidopropyl)trimethylammonium chloride (APTAC), and 3-(methacrylamidopropyl)trimethylammonium chloride (MAPTAC). The preferred cationic monomers are DADMAC, APTAC, and MAPTAC.

Without wishing to be bound by theory, the cationic monomer in the prepolymer allows the glyoxalated polyacrylamide polymer to adhere to the negatively charged cellulose fibers and/or other anionic species typical in a recycled furnish via ionic interaction. With an excessively low cationic charge, the ionic attraction is not sufficient to significantly enhance the effectiveness of the glyoxalated acrylamide-containing polymer. With an excessively high cationic charge, however, the prepolymer has too few terminal amide linkages to be effectively functionalized by glyoxal.

Some cationic aqueous dispersion polymers useful in the present invention are described in U.S. Pat. No. 7,323,510. As disclosed therein, a polymer of that type is composed generally of two different polymers: (1) A highly cationic dispersant polymer of a relatively lower molecular weight ("dispersant polymer"), and (2) a less cationic polymer of a relatively higher molecular weight that forms a discrete particle phase when synthesized under particular conditions ("discrete phase"). This invention teaches that the dispersion has a low inorganic salt content.

The cationic nature of the cationic aqueous dispersion polymer is critical to the performance of the polymer. An anionic dispersion-type polymer of approximately the same molecular weight does not provide the same benefit to drainage performance as the cationic aqueous dispersion polymer. Without wishing to be bound by theory, we propose that the highly anionic dispersant polymer present in such an anionic aqueous dispersion polymer more profoundly diminishes drainage performance than the highly cationic dispersant polymer present in the cationic aqueous dispersion polymer. Moreover, the anionic aqueous dispersion polymer is less effective in forming ionic bonds with the negatively charged pulp fibers, thereby decreasing its effectiveness as a dry strength additive.

The dispersant polymer of the cationic aqueous dispersion polymer is most effective when made as a homopolymer of a cationic monomer. The dispersant polymer could also be a copolymer of a neutral monomer, such as acrylamide, with a cationic monomer; or, the dispersant polymer could also be a copolymer of two or more cationic monomers.

Suitable cationic monomers used to produce the dispersant polymer of the cationic aqueous dispersion include, but are not limited to, diallyldimethylammonium chloride (DADMAC), 2-(dimethylamino)ethyl acrylate, 2-(dimethylamino) ethyl methacrylate, 2-(diethylaminoethyl) acrylate, 2-(diethylamino)ethyl methacrylate, 3-(dimethylamino)propyl acrylate, 3-(dimethylamino)propyl methacrylate, 3-(diethylamino)propyl acrylate, 3-(diethylamino)propyl methacrylate, N-[3-(dimethylamino)propyl]acrylamide, N-[3-(dimethylamino)propyl]methacrylamide, N-[3-(diethylamino)propyl]acrylamide, N-[3-(diethylamino)propyl]methacrylamide, [2-(acryloyloxy)ethyl]trimethylammonium chloride, [2-(methacryloyloxy)ethyl]trimethylammonium chloride, [3-(acryloyloxy)propyl]trimethylammonium chloride, [3-(methacryloyloxy)propyl]trimethylammonium chloride, 3-(acrylamidopropyl)trimethylammonium chloride (APTAC), and 3-(methacrylamidopropyl)trimethylammonium chloride (MAPTAC). Preferable monomers are DADMAC, APTAC, and MAPTAC.

Without wishing to be bound by theory, these preferred monomers when polymerized produce especially effective dispersant polymers because of their relative hydrolytic stability at a variety of pH values, especially when compared to the hydrolytically unstable ester moiety present in several of the common cationic monomers. Also contributing to their effectiveness may be the presence of a quaternized nitrogen group, giving it charge stability at a variety of pH values, especially relative to the tertiary amine groups present in several common cationic monomers. Without wishing to be bound by theory, cationic monomers containing ester groups, for example, 2-[(acryloyloxy)ethyl]trimethylammonium chloride, can hydrolyze to generate the anionic moieties, either of which may form a gelled or prohibitively high viscosity product which is not useful in papermaking. Moreover, the hydrolysis of the relatively expensive cationic acrylate group represents a significant financial loss when considering the cationic acrylamide-containing polymer. Without wishing to be bound by theory, cationic monomers, such as DADMAC, APTAC, and MAPTAC are resistant both to hydrolysis in aqueous solutions, making them preferred as cationic monomers in the dispersant polymer.

The molecular weight of the dispersant polymer is another parameter important to the performance of the cationic aqueous dispersion polymer. The molecular weight of the dispersion polymer is in the range of from 10,000 to 150,000 daltons, more preferably of from 20,000 to 100,000 daltons, most preferably of from 30,000 to 80,000 daltons. Without wishing to be bound by theory, a molecular weight below these ranges creates a more significant negative impact on the drainage performance of the final product. On the other hand, when the molecular weight is above the aforementioned ranges, the viscosity of the dispersion polymer is too high to form a viscosity-stable final product, which will attain a viscosity too high to be desirable or useful. The highly cationic dispersant polymer, by itself, does not provide the positive drainage performance observed in the presence of the cationic aqueous dispersion polymer.

The discrete phase of the cationic aqueous dispersion polymer is made while copolymerizing acrylamide and a cationic comonomer via free radical polymerization. Suitable comonomers include, but are not limited to, diallyldimethylammonium chloride (DADMAC), 2-(dimethylamino)ethyl acrylate, 2-(dimethylamino)ethyl methacrylate, 2-(diethylaminoethyl) acrylate, 2-(diethylamino)ethyl methacrylate, 3-(dimethylamino)propyl acrylate, 3-(dimethylamino)propyl methacrylate, 3-(diethylamino)propyl acrylate, 3-(diethylamino)propyl methacrylate, N-[3-(dimethylamino)propyl]acrylamide, N-[3-(dimethylamino)propyl] methacrylamide, N-[3-(diethylamino)propyl]acrylamide, N-[3-(diethylamino)propyl]methacrylamide, [2-(acryloyloxy)ethyl]trimethylammonium chloride, [2-(methacryloyloxy)ethyl]trimethylammonium chloride, [3-(acryloyloxy) propyl]trimethylammonium chloride, [3-(methacryloyloxy) propyl]trimethylammonium chloride, 3-(acrylamidopropyl) trimethylammonium chloride, and 3-(methacrylamidopropyl)trimethylammonium chloride. A preferred monomer is [2-(acryloyloxy)ethyl]trimethylammonium chloride.

The amount of cationic monomer incorporated into the discrete phase polymer of the cationic aqueous dispersion polymer may be from 5% to 60%, more preferably from 7% to 55%, most preferably from 9% to 50% on a molar basis of the monomers incorporated into the discrete phase polymer of the cationic aqueous dispersion polymer. The discrete phase of the cationic aqueous dispersion polymer may be cross-linked with an agent such as methylene bisacrylamide (MBA) provided the molecular weight and charge guidelines are met as described herein.

Without wishing to be bound by theory, the positively charged monomer allows the cationic aqueous dispersion polymer to adhere to the cellulose fibers due to a charge-charge interaction with negatively charged substances in the pulp slurry, including, but not limited to: pulp fibers, hemicellulose, oxidized starch commonly found in recycled cellulose furnish, anionic strength aids such as carboxymethylcellulose, and anionic trash. Without wishing to be bound by theory, the hydrogen-bonding components, such as amide groups, of an acrylamide-containing polymer, such as the discrete phase, are effective in enhancing the dry strength of the paper product.

The molecular weight of the cationic aqueous dispersion polymer is a critical parameter of the drainage performance of the polymer. However, separation of the discrete phase from the dispersant polymer is extremely difficult. Thus, the molecular weight of the discrete phase is best described and characterized as the molecular weight of the final product, the combination of both the highly cationic dispersant polymer and the higher molecular weight discrete phase polymer. The molecular weight of the cationic aqueous dispersion polymer is in the range of from 250,000 to 2,500,000 daltons, more preferably from 300,000 to 1,750,000 daltons, more preferably from 400,000 to 1,500,000 daltons, most preferably from 400,000 to 1,200,000 daltons. Without wishing to be bound by theory, this molecular weight allows the cationic aqueous dispersion polymer to be used in relatively high amounts without overflocculating the sheet. When these additives are used in relatively high amounts, the hydrogen-bonding motifs are more likely to interact with the glyoxalated polyacrylamide polymer and cellulose fibers to increase the dry strength of the paper product. Moreover, the preferred cationic aqueous dispersion polymer product contains no mineral oil, and thus requires no breaker and surfactant packages to use on a paper machine, as typical emulsion or reverse emulsion drainage aids do, thus reducing their economic and ecological impact.

Without wishing to be bound by theory, a cationic aqueous dispersion polymer as described herein can have higher active polymer solids content than other solution-based acrylamide-containing polymers of equal molecular weight. Because the discrete phase of the cationic aqueous dispersion polymer is formed as a dispersed particle rather than a water-solvated and water swellable polymer coil, intermolecular entanglement, and thus the tendency to form high viscosity gels is reduced when compared to a solution-based acrylamide-containing polymer of equal molecular weight.

The cationic aqueous dispersion polymer is more effective at improving drainage performance than anionic water soluble additives, such as carboxymethylcellulose (CMC) or solution-based anionic acrylamide-containing polymers, which are known to contribute a great deal of dry strength when used in conjunction with cationic additives, but are also known to retard drainage performance in papermaking systems.

Without wishing to be bound by theory, cationic aqueous dispersion polymers are more effective than other drainage aids of its general molecular weight, such as vinylamine-containing polymers, when used in conjunction with optical brightening agents (OBA). The quaternized amine functionality, in contrast with the primary amine functionality of typical vinylamine-containing polymers is less potent in quenching the effect of OBA. Moreover, whereas the effectiveness of vinylamine-containing polymers as drainage aids decreases with decreasing primary amine functionality, cationic aqueous dispersion polymers retain most of their drainage function, even as the cationic comonomer concentration decreases. Without wishing to be bound by theory, the molecular weight of the cationic aqueous dispersion polymer is a more dominant factor than the overall cationic charge or cationic comonomer concentration in determining the drainage performance of the polymer.

Cationic aqueous dispersion polymers, where the dispersion has a high inorganic salt content, are also useful in the present invention, such as those disclosed in U.S. Pat. No. 5,938,937, for example. Such dispersions are commonly referred to as "brine dispersions." Prior art referred to in U.S. Pat. No. 5,938,937, as well as art referencing U.S. Pat. No. 5,938,937, teaches that various combinations of low molecular weight highly cationic dispersion polymers and elevated inorganic salt content can be effective in producing a cationic aqueous dispersion polymer. Such dispersions would also be useful in the present invention.

Cationic aqueous dispersion polymers and glyoxalated acrylamide-containing polymers can be added during the papermaking process in the wet end either in the thick stock, or in the thin stock; either before or after a shear point. The cationic aqueous dispersion polymer may be added first in the wet end of the paper machine, followed by the glyoxalated polyacrylamide polymer; the glyoxalated acrylamide-containing polymer may be added at the same point in the wet end of the paper machine as the cationic aqueous dispersion polymer; or, more preferably, the glyoxalated acrylamide-containing polymer may be added first in the wet end of the paper machine, followed by the cationic aqueous dispersion polymer.

The cationic aqueous dispersion polymer and the glyoxalated acrylamide-containing polymer may be added to the wet end of a paper machine in a ratio of from 1:50 to 10:1 of cationic aqueous dispersion polymer to glyoxalated acrylamide-containing polymer as a ratio of polymer solids; more preferably in a ratio of from 1:10 to 5:1, more preferably in the range of from 1:5 to 3:1, most preferably in the range of from 1:5 to 2:1. Total amounts of the polymer blend (cationic aqueous dispersion polymer and the glyoxalated acrylamide-containing polymer) may be added to the pulp slurry in the wet end of the paper machine in amounts of up to 1.20%, more preferably up to 0.80%, most preferably up to 0.60% of the weight of dry pulp on a total active polymer solids basis. The minimum amount to be used is 0.05% of the weight of dry pulp on a total polymer solids basis.

In another embodiment, this invention can be applied to any of the various grades of paper that benefit from enhanced dry strength including but not limited to linerboard, bag, boxboard, copy paper, container board, corrugating medium, file folder, newsprint, paper board, packaging board, printing and writing, tissue, towel, and publication. These paper grades can be comprised of any typical pulp fibers including groundwood, bleached or unbleached Kraft, sulfate, semi-mechanical, mechanical, semi-chemical, and recycled. They may or may not include inorganic fillers.

The embodiments of the invention are defined in the following Examples. It should be understood that these Examples are given by way of illustration only. Thus various modifications of the present invention in addition to those shown and described herein will be apparent to those skilled in the art from the foregoing description. Although the invention has been described with reference to particular means, materials and embodiments, it is to be understood that the invention is not limited to the particulars disclosed, and extends to all equivalents within the scope of the appended claims.

EXAMPLES

Size exclusion chromatography (SEC) was used to measure molecular weight. The analysis was accomplished using gel permeation columns (CATSEC 4000+1000+300+100) and Waters 515 series chromatographic equipment with a mixture of 1% $NaNO_3$/0.1% Trifluoroacetic acid in 50:50 $H_2O$:$CH_3CN$ as the mobile phase. The flow rate was 1.0 mL/min. The detector was a Hewlett Packard 1047A differential refractometer. Column temperature was set at 40° C. and the detector temperature was at 35° C. The number average ($M_n$) and weight average molecular weight ($M_w$) of the polymers were calculated relative to the commercially available narrow molecular weight standard poly(2-vinyl pyridine).

Linerboard paper was made using a pilot papermaking machine. The paper pulp was a 100% recycled medium with 50 ppm hardness, 25 ppm alkalinity, 2.5% GPC D15F oxidized starch (Grain Processing Corp., Muscatine, Iowa) and 2000 uS/cm conductivity. The system pH was 7.0 unless indicated otherwise, and the pulp freeness was about 380 CSF with the stock temperature at 52° C. The basis weight was 100 lbs per 3000 $ft^2$. Unless otherwise indicated, Stalok 300 cationic starch (Tate & Lyle PLC, London, UK) and PerForm® PC 8713 flocculant (Hercules Incorporated, Wilmington, Del.) were added to the wet end of the paper machine in the amount of 0.5% and 0.0125% of dry pulp, respectively. Cationic aqueous dispersion polymers and glyoxalated acrylamide-containing polymers as described in the examples were added as dry strength agents to the wet end of the papermaking machine at the indicated levels, expressed as a percentage of weight of polymer active versus dry paper pulp. Ring crush, dry Mullen burst, and dry tensile tests were used to measure the direct dry strength effects of the chemical treatments.

Drainage efficiency of the various polymeric systems was compared using the vacuum drainage test (VDT). The device setup is similar to the Buchner funnel test as described in various filtration reference books, for example see Perry's Chemical Engineers' Handbook, 7th edition, (McGraw-Hill, New York, 1999) pp. 18-78. The VDT consists of a 300-ml magnetic Gelman filter funnel, a 250-ml graduated cylinder, a quick disconnect, a water trap, and a vacuum pump with a vacuum gauge and regulator. The VDT test was conducted by first setting the vacuum to 10 inches Hg, and placing the funnel properly on the cylinder. Next, 250 g of 0.5 wt. % paper stock was charged into a beaker and then the required additives according to treatment program (e.g., starch, cationic aqueous dispersion polymer, glyoxalated acrylamide-containing polymer, flocculants) were added to the stock under the agitation provided by an overhead mixer. The stock was then poured into the filter funnel and the vacuum pump was turned on while simultaneously starting a stopwatch. The drainage efficacy can be reported as the time required to obtain 230 mL of filtrate. Alternatively, the drainage efficacy can be reported as a percentage of performance versus the treatment with no polymer added (blank). The results of the two drainage tests were normalized and expressed as a percentage of the drainage performance observed versus a system that did not include the cationic aqueous dispersion polymer or glyoxalated acrylamide-containing polymer.

It is useful to consider ways that a papermaker may achieve dry strength through both direct and indirect means. For instance, a given treatment may provide greater hydrogen bonding between the chemical and the paper fibers, resulting in greater dry strength. This direct form of dry strength allows a papermaker to make high performance grades of paper, achieve a specified strength target at a lower basis weight, or use a lower grade of furnish to achieve a desired strength target.

On the other hand, a skilled papermaker may utilize a chemical that results in greater drainage performance to indirectly increase the dry strength of his paper product by reducing the consistency of the pulp slurry and thereby improving formation of the sheet; alternatively, the papermaker may increase refining to gain greater dry strength without the usual loss in paper machine productivity. Therefore, drainage performance on the paper machine is not only critical to the productivity of the paper machine, but also to the dry strength of the paper product.

Because different measures of dry strength, such as Müllen burst test, ring crush test, and dry tensile test all have different importance to different papermakers on different grades of paper, it is useful to combine those measures into one index to evaluate the overall dry strength resulting from a chemical treatment. By considering the importance of drainage performance that a papermaker may transform into dry strength by the methods mentioned above, a single strength index is more complete than looking at the results of any one given test or even several tests separate from the drainage data.

Because chemical treatments frequently affect drainage performance and dry strength performance differently, this combined index is useful in offering a more comprehensive evaluation of their overall effectiveness. For instance, a given chemical treatment may give good dry strength, but impede drainage; or, a treatment may give good drainage performance, but hurts strength due to overflocculation of the sheet. With a combined strength drainage index (SDI), these two disparate treatments could be more completely compared.

The SDI can be calculated as follows: First, the dry strength index (DSI) of treated paper as a percentage of performance of untreated paper in traditional tests such as Mullen burst, ring crush, dry tensile, or other dry strength tests is calculated, Second, the drainage performance of a pulp slurry with a given chemical treatment relative to a slurry with no treatment is then calculated to give the drainage index (DI). The strength drainage index SDI is then calculated by taking nth root of the product of these several performance indices, where n is the number of dry strength tests, as in Equation 1.

$$SDI=(DSI_1*DSI_2*DSI_3 \ldots *DSI_n*DI)^{(1/(n+1))} \quad \text{(Equation 1)}$$

For example, if paper was tested for strength using the ring crush, Mullen burst, and dry tensile tests and indexed versus the untreated condition, and drainage performance was evaluated as indicated above, the SDI would be calculated as below:

$$SDI=(\text{Ring crush}*\text{Mullen burst}*\text{dry tensile}*\text{drainage})^{(1/4)}$$

In the examples below, the polymers are defined as follows: Polymer A is a cationic aqueous dispersion polymer comprising a dispersant polymer and a cationic charge in the discrete phase in the range of 15-40 mol %. Polymer B is a glyoxalated acrylamide-containing polymer made from a prepolymer with a molecular weight (before glyoxalation) in the range of 20,000 to 40,000 daltons. Polymer C is a cationic aqueous dispersion polymer similar to Polymer A, but having a cationic charge in the discrete phase in the range of 5-25 mol %. Comparative Polymer A is a vinylamine-containing polymer with a molecular weight in the range of from 100,000 to 500,000 daltons. The SDI was calculated using test data normalized to the average basis weight as the geometric mean, where applicable, in the ring crush, Mullen burst, and dry tensile tests. The drainage performance was measured using the vacuum drainage test, and indexed to the untreated condition.

Example 1

Polymer A and Polymer B were combined in a coadditive system in the amounts shown.

TABLE 1

| Entry | Polymer A Addition (%) | Polymer B Addition (%) | SDI |
|---|---|---|---|
| 1 | — | — | 100.0 |
| 2 | — | 0.1 | 99.1 |
| 3 | — | 0.25 | 101.9 |
| 4 | — | 0.4 | 102.2 |
| 5 | 0.05 | — | 104.6 |
| 6 | 0.05 | 0.1 | 105.2 |
| 7 | 0.05 | 0.25 | 106.9 |
| 8 | 0.05 | 0.4 | 108.8 |
| 9 | 0.25 | — | 113.8 |
| 10 | 0.25 | 0.1 | 114.7 |
| 11 | 0.25 | 0.25 | 115.5 |
| 12 | 0.25 | 0.4 | 116.7 |

The data illustrates that the combined coadditive system shows better performance as measured by SDI than either system alone.

Example 2

Comparative Polymer A, a vinylamine-containing polymer, was combined with Polymer B in a coadditive system that has been cited in the prior art to give significant benefit to dry strength and drainage. That system was compared to the coadditive system of Polymer B and Polymer C.

TABLE 2

| Entry | Polymer B (% of Dry Pulp) | $2^{nd}$ Polymer | Amt. $2^{nd}$ polymer (% of Dry Pulp) | SDI |
|---|---|---|---|---|
| 1 | — | — | — | 100.0 |
| 2 | 0.2 | — | — | 104.4 |
| 3 | 0.4 | — | — | 108.0 |
| 4 | 0.6 | — | — | 108.3 |
| 5 | — | Comp. Polymer A | 0.1 | 107.5 |
| 6 | — | Polymer C | 0.1 | 111.5 |
| 7 | 0.2 | Comp. Polymer A | 0.1 | 107.7 |
| 8 | 0.2 | Polymer C | 0.1 | 113.8 |
| 9 | 0.4 | Comp. Polymer A | 0.1 | 107.8 |
| 10 | 0.4 | Polymer C | 0.1 | 116.8 |
| 11 | 0.6 | Comp. Polymer A | 0.1 | 109.0 |
| 12 | 0.6 | Polymer C | 0.1 | 114.0 |
| 13 | — | Comp. Polymer A | 0.2 | 102.5 |
| 14 | — | Polymer C | 0.2 | 108.0 |
| 15 | 0.2 | Comp. Polymer A | 0.2 | 104.6 |
| 16 | 0.2 | Polymer C | 0.2 | 111.9 |
| 17 | 0.4 | Comp. Polymer A | 0.2 | 104.7 |
| 18 | 0.4 | Polymer C | 0.2 | 116.1 |
| 19 | 0.6 | Comp. Polymer A | 0.2 | 105.0 |
| 20 | 0.6 | Polymer C | 0.2 | 119.2 |
| 21 | — | Comp. Polymer A | 0.3 | 106.9 |
| 22 | — | Polymer C | 0.3 | 112.1 |
| 23 | 0.2 | Comp. Polymer A | 0.3 | 105.8 |
| 24 | 0.2 | Polymer C | 0.3 | 112.6 |
| 25 | 0.4 | Comp. Polymer A | 0.3 | 108.0 |
| 26 | 0.4 | Polymer C | 0.3 | 115.3 |
| 27 | 0.6 | Comp. Polymer A | 0.3 | 107.6 |
| 28 | 0.6 | Polymer C | 0.3 | 117.4 |

The data illustrate that the combination of Polymer C and Polymer B is superior to Comparative Polymer A and Polymer B, as the SDI of the system using the prior art (Comparative Polymer A and Polymer B) is consistently lower than when the disclosed polymer system is used (Polymer C and Polymer B). It should be noted that the SDI is not an additive property. In other words, tripling the amount of a given polymer does not result in an SDI improvement over the blank of three times.

Example 3

A comparison of the vacuum drainage data show that the coadditive system employing cationic aqueous dispersion polymers such as Polymer C in the place of vinylamine-containing polymers (such as Comparative Polymer A) is superior in generating drainage performance. Furthermore, the retention of the system using the cationic aqueous dispersion polymers is superior to the vinylamine-containing polymer system, as illustrated by the lower turbidity data. In the case of both the drainage time and turbidity data, lower numbers indicate better performance.

TABLE 3

| Entry | Cationic Co-additive | % Addition | Polymer B Added (%) | DDA time (s) | turbidity (FAU) |
|---|---|---|---|---|---|
| 1 | none | — | — | 32.1 | 25 |
| 2 | Comp. Polymer A | 0.100 | — | 27.2 | 22 |
| 3 | Polymer C | 0.100 | — | 17.1 | 17 |
| 4 | Comp. Polymer A | 0.100 | 0.200 | 26.2 | 22 |
| 5 | Polymer C | 0.100 | 0.200 | 18.2 | 9 |
| 6 | Comp. Polymer A | 0.100 | 0.400 | 25.1 | 14 |
| 7 | Polymer C | 0.100 | 0.400 | 20.1 | 15 |
| 8 | Comp. Polymer A | 0.100 | 0.600 | 25.1 | 30 |
| 9 | Polymer C | 0.100 | 0.600 | 21.4 | 2 |
| 10 | Comp. Polymer A | 0.200 | — | 21.6 | 23 |
| 11 | Polymer C | 0.200 | — | 17.6 | 12 |
| 12 | Comp. Polymer A | 0.200 | 0.200 | 22.2 | 20 |
| 13 | Polymer C | 0.200 | 0.200 | 18.7 | 16 |
| 14 | Comp, Polymer A | 0.200 | 0.400 | 23.9 | 10 |
| 15 | Polymer C | 0.200 | 0.400 | 19.1 | 22 |
| 16 | Comp. Polymer A | 0.200 | 0.600 | 24.7 | 18 |
| 17 | Polymer C | 0.200 | 0.600 | 18.0 | 10 |
| 18 | Comp. Polymer A | 0.300 | — | 19.7 | 12 |
| 19 | Polymer C | 0.300 | — | 17.2 | 7 |
| 20 | Comp. Polymer A | 0.300 | 0.200 | 23.0 | 25 |
| 21 | Polymer C | 0.300 | 0.200 | 16.7 | 32 |
| 22 | Comp. Polymer A | 0.300 | 0.400 | 23.9 | 13 |
| 23 | Polymer C | 0.300 | 0.400 | 18.4 | 15 |
| 24 | Comp. Polymer A | 0.300 | 0.600 | 25.5 | 17 |
| 25 | Polymer C | 0.300 | 0.600 | 19.7 | 17 |

The invention claimed is:

1. A process for the production of paper, board, and cardboard with enhanced dry strength comprising the step of adding to the wet end of a paper machine (a) a glyoxalated acrylamide-containing polymer and (b) a cationic aqueous dispersion polymer, wherein the cationic aqueous dispersion polymer has a molecular weight of 250,000 to 2,500,000 daltons and wherein the ratio of cationic aqueous dispersion polymer to glyoxalated acrylamide-containing polymer is from 1:50 to 10:1.

2. The process according to claim 1 wherein the cationic aqueous dispersion polymer comprises a dispersant polymer and a discrete phase polymer.

3. The process according to claim 2 wherein the cationic aqueous dispersion polymer contains a dispersant polymer wherein the dispersant polymer incorporates at least one cationic monomer, wherein the cationic monomer is selected from the group consisting of diallyldimethylammonium chloride (DADMAC), 2-(dimethylamino)ethyl acrylate, 2-(dimethylamino)ethyl methacrylate, 2-(diethylaminoethyl)acrylate, 2-(diethylamino)ethyl methacrylate, 3-(dimethylamino) propyl acrylate, 3-(dimethylamino)propyl methacrylate, 3-(diethylamino)propyl acrylate, 3-(diethylamino)propyl methacrylate, N-[3-(dimethylamino)propyl]acrylamide, N-[3-(dimethylamino)propyl]methacrylamide, N-[3-(diethylamino)propyl]acrylamide, N-[3-(diethylamino)propyl] methacrylamide, [2-(acryloyloxy)ethyl]trimethylammonium chloride, [2-(methacryloyloxy)ethyl]trimethylammonium chloride, [3-(acryloyloxy)propyl]trimethylammonium chloride, [3-(methacryloyloxy)propyl]trimethylammonium chloride, 3-(acrylamidopropyl)trimethylammonium chloride, and 3-(methacrylamidopropyl)trimethylammonium chloride and mixtures thereof.

4. The process according to claim 3 wherein at least one cationic monomer is selected from the group consisting of diallyldimethylammonium chloride (DADMAC), 3-(acrylamidopropyl)trimethylammonium chloride (APTAC), and 3-(methacrylamidopropyl)trimethylammonium chloride (MAPTAC) and mixtures thereof.

5. The process according to claim 1 wherein the glyoxalated acrylamide-containing polymer comprises the reaction product of an acrylamide-containing prepolymer and glyoxal, and wherein the acrylamide-containing prepolymer is characterized in that it has a cationic charge of from 2-40 mol % of the total monomer content and a molecular weight of from 1,000 daltons to 250,000 daltons.

6. The process according to claim 5 wherein the acrylamide-containing prepolymer has a molecular weight of from 3,000 daltons to 75,000 daltons.

7. The process according to claim 6 wherein the acrylamide-containing prepolymer has a molecular weight of from 5,000 daltons to 50,000 daltons.

8. The process according to claim 7 wherein the degree of total glyoxal functionalization of the acrylamide moiety in the prepolymer is from 6% to 20%.

9. The process according to claim 5 wherein the degree of total glyoxal functionalization of the acrylamide moiety in the prepolymer is from 3% to 40%.

10. The process according to claim 1 wherein the cationic aqueous dispersion polymer contains a discrete phase that comprises the reaction product of acrylamide and at least one cationic monomer, wherein the cationic monomer is selected from the group consisting of diallyldimethylammonium chloride (DADMAC), 2-(dimethylamino)ethyl acrylate, 2-(dimethylamino)ethyl methacrylate, 2-(diethylaminoethyl)acrylate, 2-(diethylamino)ethyl methacrylate, 3-(dimethylamino) propyl acrylate, 3-(dimethylamino)propyl methacrylate, 3-(diethylamino)propyl acrylate, 3-(diethylamino)propyl methacrylate, N-[3-(dimethylamino)propyl]acrylamide, N-[3-(dimethylamino)propyl]methacrylamide, N-[3-(diethylamino)propyl]acrylamide, N-[3-(diethylamino)propyl] methacrylamide, [2-(acryloyloxy)ethyl]trimethylammonium chloride, [2-(methacryloyloxy)ethyl]trimethylammonium chloride, [3-(acryloyloxy)propyl]trimethylammonium chloride, [3-(methacryloyloxy)propyl]trimethylammonium chloride, 3-(acrylamidopropyl)trimethylammonium chloride, and 3-(methacrylamidopropyl)trimethylammonium chloride and mixtures thereof.

11. The process according to claim 10 wherein the cationic monomer comprises [2-(acryloyloxy)ethyl]trimethylammonium chloride.

12. The process according to claim 10 wherein the discrete phase polymer comprises from 5 to 60 mol % cationic monomer on a molar basis.

13. The process according to claim 12 wherein the discrete phase polymer comprises from 9 to 50 mol % cationic monomer on a molar basis.

14. The process according to claim 1 wherein the cationic aqueous dispersion polymer comprises a brine dispersion.

15. The process according to claim 1, wherein the cationic aqueous dispersion polymer and the glyoxalated acrylamide-containing polymer are added to the wet end of a paper machine.

16. The process according to claim 15, wherein the total combined amount of active polymer solids of cationic aqueous dispersion polymer and glyoxalated acrylamide-containing polymer is 0.05% to 0.80% on a weight basis of the dry pulp.

17. The process according to claim 16, wherein the total amount of cationic aqueous dispersion polymer and glyoxalated acrylamide-containing polymer is from 0.05% to 0.60%.

18. The process according to claim 15, wherein the ratio of cationic aqueous dispersion polymer to glyoxalated acrylamide-containing polymer is from 1:10 to 5:1.

* * * * *